US006441696B1

(12) United States Patent
Westberg

(10) Patent No.: US 6,441,696 B1
(45) Date of Patent: Aug. 27, 2002

(54) BALUN

(75) Inventor: David Westberg, Uppsala (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 0 days.

(21) Appl. No.: 09/612,129

(22) Filed: Jul. 7, 2000

(30) Foreign Application Priority Data

Jul. 8, 1999 (SE) ..... 9902629

(51) Int. Cl.[7] ..... H01P 5/10
(52) U.S. Cl. ..... 333/26; 333/128
(58) Field of Search ..... 333/26; 343/859

(56) References Cited

U.S. PATENT DOCUMENTS 2,127,088 A * 8/1938 Percival et al. ..... 250/33
3,869,678 A * 3/1975 Mahoney ..... 330/53
5,357,213 A * 10/1994 Michel et al. ..... 330/286
5,628,057 A * 5/1997 Phillips et al. ..... 455/89

FOREIGN PATENT DOCUMENTS

JP 0570125 A1 * 11/1993

OTHER PUBLICATIONS

Nishide et al., Balance–to–Unbalance Transformers, Nov. 18, 1970, Monogr.Res.Inst.Appl.Elec.(Japan), S1310–0024, pp. 69–85.*

* cited by examiner

*Primary Examiner*—Robert Pascal
*Assistant Examiner*—Joseph Chang
(74) *Attorney, Agent, or Firm*—Burns, Doane, Swecker & Mathis, L.L.P.

(57) ABSTRACT

The present invention relates to a balun circuit that includes means for transforming a balanced input signal to an unbalanced signal and impedance changing means. The means for transforming the balun input signal to an unbalanced output signal is a λ/2-waveguide (30). A first side of the λ/2-waveguide (30) is connected to a second port (P2) of the balun circuit, while a second side of said λ/2-waveguide (30) is connected to a third port (P3) of the balun circuit. The impedance changing means is a λ/4-waveguide (40) of which a first side is connected to a second side of the λ/2-waveguide (30) and a second side is connected to the first port (P1) of the balun circuit.

5 Claims, 2 Drawing Sheets

BALUN

This application claims priority under 35 U.S.C. §§119 and/or 365 to 9902629-6 filed in Sweden on Jul. 8, 1999; the entire content of which is hereby incorporated by reference.

FIELD OF INVENTION

The present invention relates to a balun circuit according to the preamble of claim 1.

DESCRIPTION OF THE BACKGROUND ART

High frequency electric signals can be transmitted in two often occurring ways, namely balanced and unbalanced. In balanced transmission there is used two conductors in which electric currents are constantly in antiphase. Unbalanced transmission, on the other hand, uses only one signal conductor and the signal (the current) is returned via earth. The balanced transmission is differential in nature and thus less sensitive to disturbances and interference than the unbalanced transmission.

Balanced and unbalanced transmissions are often mixed in radio systems. It is therefore necessary to enable a balanced signal to be converted to an unbalanced signal, and vice versa, with the smallest losses possible. Baluns are used to this end.

The properties of a balun circuit depend on impedance difference and phase difference for odd and even modes in the high frequency electric signal.

A typical balun is the so-called Marchand balun. The Marchand balun includes four $\lambda/4$-waveguides coupled in pairs. The Marchand balun gives a 4:1 transformation, which means that a differential impedance applied to the balun input shall be four times greater than an impedance desired on an output of the Marchand balun.

This is achieved by connecting a matching network to the actual Marchand balun. In the majority of situations in which baluns are used in practice, the impedance on an unbalanced output shall be 50Ω. When the Marchand balun is used, the impedance on the balun input shall thus be transformed to 200Ω via said matching network.

When using the Marchand balun, a transformation effected with the aid of said matching network will have a very narrow band and be sensitive to scattering in both load impedance and in the individual components in the matching network, which constitutes a problem. This solution also results in pronounced scattering in output power from the balun, which also constitutes a problem.

SUMMARY OF THE INVENTION

One object of the present invention is to provide a balun circuit which will at least reduce the aforesaid problems.

This object is achieved in accordance with a first aspect of the present invention with a balun circuit according to claim 1.

One advantage afforded by the inventive balun circuit is that certain variations in implementation can be allowed without experiencing excessive reduction in the balun circuit output power.

Another advantage afforded by the inventive balun circuit is that all ports on the circuit can be biased in a simple manner with the aid of a minimum of components to this end.

Another advantage afforded by the inventive balun circuit is that it can be implemented in a comparatively compact form on or in a substrate.

The invention will now be described in more detail with reference to preferred embodiments thereof and also with reference to the accompanying drawings.

DESCRIPTION OF PREFERRED EMBODIMENTS

Figure 1:
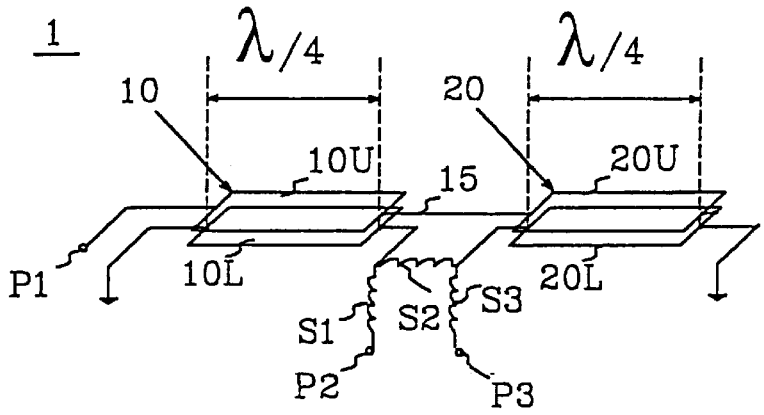
PRIOR ART Fig. 1
FIG. 1 is a principle diagram illustrating a balun circuit according to the present standpoint of techniques.

With the intention of providing a better understanding of the features of the invention, reference is made first to FIG. 1 which illustrates a classic Marchand balun that includes a matching circuit.

FIG. 1 shows a balun circuit 1 that includes a classic Marchand balun and an associated matching circuit. The classic Marchand balun includes a first and a second sub-circuit 10 and 20 respectively. The first sub-circuit 10 includes an upper conductor 10U, a lower conductor 10L and a dielectric layer disposed between said conductors. The upper conductor 10U and the lower conductor 10L in the first sub-circuit 10 are capacitively and inductively connected together with a given coupling constant. The first sub-circuit 10 corresponds to or essentially to a first $\lambda/4$-waveguide. Similarly, the second sub-circuit 20 includes an upper conductor 20U and a lower conductor 20L and a dielectric layer disposed between said conductors. The upper conductor 20U and the lower conductor 20L in the second sub-circuit 20 are connected together capacitively and inductively with a given coupling constant. The second sub-circuit corresponds to or at least essentially to a second $\lambda/4$-waveguide.

An input P1 is connected to a first side of the upper conductor 10U in the first sub-circuit 10. A second side of the upper conductor 10U in the first sub-circuit 10 is connected to a first side of the upper conductor 20U in the second sub-circuit 20, via a connecting conductor 15. A second side of the upper conductor 20U in the second sub-circuit 20 is open. A first side of the lower conductor 10L in the first sub-circuit 10 is connected to earth. A second side of the lower conductor 10L in the first sub-circuit 10 is connected to a first side on the lower conductor 20L in the second sub-circuit 20, via a first coil S2. A first input port P2 is connected to the first side of the first coil S2, via a second coil S1. A second input port P3 is connected to a second side of the first coil S2, via a third coil S3. A second side on the lower conductor 20L in the second sub-circuit 20 is conducted to earth. In the illustrated embodiment, the matching circuit includes the coils S1, S2 and S3. The value on the coils is dependent on the value assumed by a load applied to the input port P2 and P3. In the illustrated embodiment, it is assumed that the impedance of the load is generally capacitive and that the inductance of the coils preferably transforms this generally capacitive impedance to a really true or almost really true impedance. When a really true impedance of 50Ω is desired on the output the impedance on the input of the Marchand balun must be 200Ω because the Marchand balun gives a 4:1 transformation.

Figure 2:
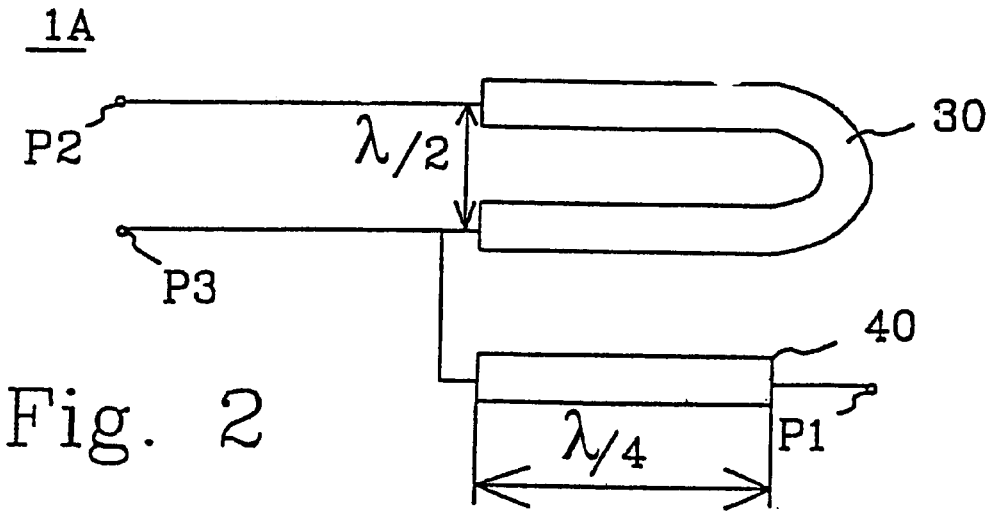
FIG. 2 illustrates a first embodiment of an inventive balun circuit.

FIG. 2 illustrates a first embodiment of an inventive balun circuit 1A. The balun circuit 1A includes a λ/2-waveguide 30, where a first side of the λ/2-waveguide 30 is connected to a first input P2 on the balun circuit 1A and where a second side of the λ/2-waveguide 30 is connected to a second input P3 of the balun circuit 1A. A first side of a λ/2-waveguide 40 is connected to the second side of λ/2-waveguide 30, and a second side is connected to the output P1 of the balun circuit. A balanced input signal applied to the inputs P2 and P3 of the balun circuit is transformed to an unbalanced signal through λ/2-waveguide 30. An impedance connected to the two inputs of the balun circuit is changed by the λ/4-waveguide 40 so that an impedance downstream of the balun circuit is increased or decreased relative to the impedance connected to the inputs of said balun circuit.

Figure 3:
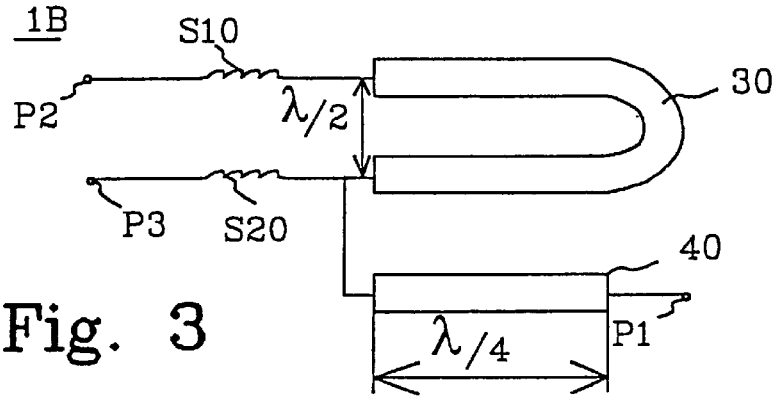
FIG. 3 illustrates a second embodiment of an inventive balun circuit.

FIG. 3 illustrates a second embodiment of an inventive balun circuit 1B. The balun circuit 1B includes a λ/2-waveguide 30, where a first side of the λ/2-waveguide 30 is connected to a first input P2 of a balun circuit 1A via a first coil S10, and where a second side on the λ/2-waveguide 30 is connected to a second input P3 of the balun circuit 1A via a second coil S20. A first side of a λ/4-waveguide 40 is connected to the second side of the λ/2-waveguide 30, while a second side is connected to the output P1 of the balun circuit. A balanced input signal applied to the inputs P2 and P3 of the balun circuit is transformed to an unbalanced signal through the λ/2-waveguide 30. An impedance of a load connected to the two inputs of the balun circuit is changed by the λ/4-waveguide 40 so that an impedance downstream of the balun circuit will be either increased or decreased relative to said load impedance. The coils S10 and S20 equalise a generally capacitive impedance of the load applied to the inputs of the balun circuit, so that said impedance will be a completely or essentially completely real impedance after the balun circuit.

Figure 4:
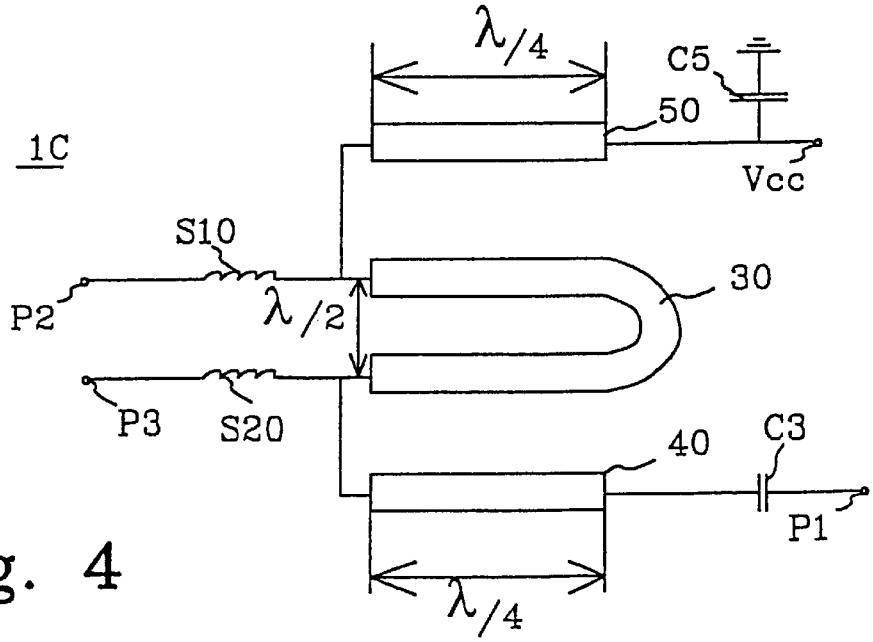
FIG. 4 illustrates a third embodiment of an inventive balun circuit.

FIG. 4 illustrates a third embodiment of an inventive balun circuit lC. The balun circuit 1C includes a λ/2-waveguide 30, where a first side of the λ/2-waveguide 30 is connected to a first input P2 of the balun circuit 1A via a first coil S10, and where a second side on the λ/2-waveguide 30 is connected to a second input P3 of the balun circuit 1A, via a second coil S20. A first side of a first λ/4-waveguide 40 is connected to the second side of the λ/2-waveguide 30, and a second side is connected to the output P1 of the balun circuit via a first capacitance C3. A first side of a second λ/4-waveguide 50 is connected to the first side of the λ/2-waveguide 30, while a second side is connected to a voltage source Vcc and a first side of a second capacitor C5. A second side of said second capacitor C5 is connected to earth.

A balanced input signal applied to the inputs P2 and P3 of the balun circuit is transformed to an unbalanced signal through the λ/2-waveguide 30. A load impedance connected to the two inputs of the balun circuit is changed by the first λ/4-waveguide 40 so that an impedance after the balun circuit will either be increased or decreased relative to said load impedance. The voltage source Vcc, the second capacitor C5 and the second λ/4-waveguide 50 connected to the first side of the λ/2-waveguide function to bias components arranged in the load, for instance transistors. The value of the second capacitor C5 is selected so that said capacitor will be resonant at a relevant frequency of the input signal and thus behave RF-wise as a short circuit to earth. The λ/4-waveguide 50 rotates an RF-wise short circuit so that it appears to be RF-wise open. The capacitor C3 insulates/protects a device connected to the input P1 of the balun circuit from undesired direct-current voltage.

Figure 5:
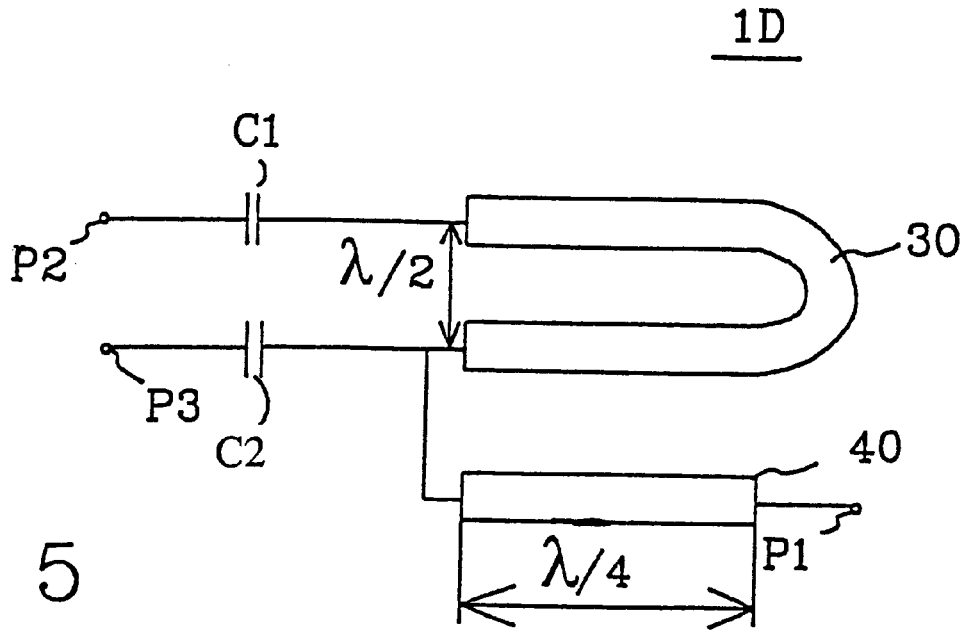
FIG. 5 illustrates a fourth embodiment of an inventive balun circuit.

FIG. 5 illustrates a fourth embodiment of an inventive balun circuit 1D. The balun circuit 1D includes a λ/2-waveguide 30, where a first side of the λ/2-waveguide 30 is connected to a first input P2 of the balun circuit 1A via a third capacitor C1, and where a second side of the λ/2-waveguide 30 is connected to a second input P3 of the balun circuit 1A via a fourth capacitor C2. A first side of a λ/4-waveguide 40 is connected to the second side of the λ/2-waveguide 30, while a second side is connected to the output P1 of the balun circuit. A balanced input signal applied to the inputs P2 and P3 of the balun circuit is transformed through an unbalanced signal through the λ/2-waveguide 30. An impedance of a load connected to the two inputs of the balun circuit is changed by the λ/4-waveguide 40 so that an impedance after the balun circuit is increased or decreased relative to the load impedance. The capacitor C1 and C2 equalise an essentially inductive impedance of the load connected to the inputs of the balun circuit, so that said inductive impedance will be a truly or essentially truly real impedance after the balun circuit.

The λ/2-waveguide and the %4-waveguides in preferred embodiments of the balun circuits 1A–1D may be made of metal, for instance a silver alloy, copper, tungsten or aluminum.

Although the illustrated balun circuits 1A–1D will function for all wavelengths, each λ/4-waveguide and each λ/2-waveguide must have a length that can be managed in purely practical terms.

At least one of the coils S10 and S20 can be trimmed. At least one of the capacitors C1 and C2 can be trimmed.

The balun circuits. 1A–1D may be of the microstrip or stripline kind.

In the description balun circuit inputs and outputs have been used to define where the balun input signal shall be applied in order to obtain the unbalanced output signal in the balun circuit. It will be understood that an unbalanced input signal can be transformed to a balanced output signal, although in this case the inputs and the outputs will change places in comparison with the aforedescribed case.

It will also be understood that the invention is not restricted to the aforedescribed and illustrated embodiments thereof, and that modifications can be made within the scope of the accompanying claims.

What is claimed is:

1. A balun circuit comprising:

a $\lambda/2$ waveguide, a first end of said $\lambda/2$ waveguide being connected to a first port of the balun circuit via a first coil, a second end of the said $\lambda/2$ waveguide being connected to a second port of the balun circuit via a second coil;

a first $\lambda/4$ waveguide, a first end of the first $\lambda/4$ waveguide being connected to said second end of the $\lambda/2$ waveguide, a second end of the first $\lambda/4$ waveguide being connected to a third port of the balun circuit via a first capacitor; and biasing means for biasing components in a load connected between said first and second ports of the balun circuit, the biasing means comprising:

a second $\lambda/4$ waveguide, a first end of the second $\lambda/4$ waveguide being connected to said first end of the $\lambda/2$ waveguide, a second end of the second $\lambda/4$ waveguide being connected to a voltage source and to one electrode of a second capacitor, the other electrode of the second capacitor being connected to ground.

2. The balun circuit according to claim 1, wherein at least one of said first and second coils is trimable.

3. The balun circuit according to claim 1, wherein the balun circuit is implemented in stirpline form.

4. The balun circuit according to claim 1, wherein the balun circuit is implemented in microstrip form.

5. The balun circuit according to claim 1, wherein said first and second coils and said first and second capacitors are disposed on one and the same substrate.

* * * * *